US005946994A

United States Patent [19]

Tether et al.

[11] Patent Number: 5,946,994

[45] Date of Patent: Sep. 7, 1999

[54] VOID FILL MATERIAL AND PROCESS FOR MANUFACTURING SAME

[75] Inventors: Russell Wells Tether, Dallas; Gregory Scott Herbig, Duncanville, both of Tex.

[73] Assignee: Corropak, Inc., Dallas, Tex.

[21] Appl. No.: 08/287,143

[22] Filed: Aug. 8, 1994

Related U.S. Application Data

[63] Continuation of application No. 08/078,405, Jun. 17, 1993, abandoned, which is a continuation-in-part of application No. 07/959,774, Oct. 13, 1992, Pat. No. 5,254,389, which is a continuation-in-part of application No. 07/804,995, Dec. 11, 1991, Pat. No. 5,188,880.

[51] Int. Cl.[6] ..... B26D 1/00

[52] U.S. Cl. ..... 83/32; 83/38; 83/39; 83/923

[58] Field of Search ..... 83/32, 37, 38, 83/39, 343, 99, 300, 301, 302, 346, 347, 906, 923; 493/967

[56] References Cited

U.S. PATENT DOCUMENTS

| | | | |
|---|---|---|---|
| 3,074,543 | 1/1963 | Stanley . | |
| 3,188,264 | 6/1965 | Holden . | |
| 3,269,235 | 8/1966 | Crouch et al. . | |
| 3,380,328 | 4/1968 | Martin . | |
| 3,381,563 | 5/1968 | Bishop . | |
| 3,410,183 | 11/1968 | Sarka . | |
| 3,448,684 | 6/1969 | Cardinet et al. . | |
| 3,526,163 | 9/1970 | Lowery . | |
| 3,559,866 | 2/1971 | Olson, Sr. . | |
| 3,599,520 | 8/1971 | Wood . | |
| 3,690,647 | 9/1972 | Matsuo . | |
| 3,766,814 | 10/1973 | Kesten . | |
| 3,875,836 | 4/1975 | Hutchinson . | |
| 3,880,030 | 4/1975 | Rosengren . | |
| 3,894,632 | 7/1975 | Sieffert . | |
| 3,951,730 | 4/1976 | Wennberg et al. . | |
| 3,956,974 | 5/1976 | Schroter . | |
| 3,965,786 | 6/1976 | D'Luhy . | |
| 3,981,213 | 9/1976 | Lopman . | |
| 4,012,978 | 3/1977 | de Lanauze . | |
| 4,031,600 | 6/1977 | Whigham . | |
| 4,073,207 | 2/1978 | Kirkpatrick . | |
| 4,073,208 | 2/1978 | Kirkpatrick . | |
| 4,120,443 | 10/1978 | Gardner et al. . | |
| 4,169,179 | 9/1979 | Bussey, Jr. . | |
| 4,205,596 | 6/1980 | Chesnut . | |
| 4,224,851 | 9/1980 | Imai . | |
| 4,240,312 | 12/1980 | Ward, Sr. . | |
| 4,240,313 | 12/1980 | Gillespie . | |
| 4,295,843 | 10/1981 | Otomaru . | |
| 4,300,421 | 11/1981 | Yano et al. | 83/99 |
| 4,343,215 | 8/1982 | Fuchs . | |
| 4,369,682 | 1/1983 | Bunnell . | |
| 4,474,565 | 10/1984 | Watson et al. . | |
| 4,499,801 | 2/1985 | Reba et al. | 83/99 |
| 4,514,453 | 4/1985 | Bussey, Jr. . | |
| 4,621,022 | 11/1986 | Kohaut et al. . | |
| 4,643,062 | 2/1987 | Highfield et al. . | |
| 4,770,078 | 9/1988 | Gautier . | |
| 4,848,204 | 7/1989 | O'Connor et al. . | |
| 4,997,134 | 3/1991 | MacGregor . | |
| 5,027,509 | 7/1991 | Barben et al. . | |
| 5,181,614 | 1/1993 | Watts . | |

*Primary Examiner*—M. Rachuba
*Attorney, Agent, or Firm*—Jones Day Reavis & Pogue

[57] ABSTRACT

Void fill material is used to cushion and protect packages during transport and delivery. A void fill material is shown, as well as a process for manufacturing same.

20 Claims, 5 Drawing Sheets

VOID FILL MATERIAL AND PROCESS FOR MANUFACTURING SAME

The present application is a continuation of application Ser. No. 08/078,405, filed on Jun. 17, 1993, now abandoned, which is a continuation-in-part of application Ser. No. 07/959,774, filed on Oct. 13, 1992, now U.S. Pat. No. 5,254,389 issued on Oct. 19, 1993, which is a continuation-in-part of application Ser. No. 07/804,995, filed on Dec. 11, 1991, now U.S. Pat. No. 5,188,880 issued on Feb. 23, 1993.

TECHNICAL FIELD OF THE INVENTION

This invention relates to packing and void fill material and a process for manufacturing same.

BACKGROUND OF THE INVENTION

Recently, an increased awareness has arisen about the potential detrimental impact of certain consumer products on the environment. A chemical in certain products which appears to cause great harm to the environment is chlorofluorocarbon (CFC). This chemical is used in many types of void fill packing materials made of polystyrene. Void fill packing material is necessary to provide cushion or protection of a packaged product during delivery and mailing. Apart from the disadvantages of polystyrene possessing CFCs, polystyrene also does not decompose rapidly thereby adding to the material entering land fills and waste dumps.

Polystyrene void fill material is often called polystyrene "peanuts" and comes in a variety of shapes and sizes. Polystyrene "peanuts" are lightweight and are easily positioned around a product in its package through the use of a suspended hopper assembly having a lower spout for pouring the "peanuts" into their proper placement. Polystyrene "peanuts" work well in this hopper assembly due to their good flow rate through the lower spout. That is, these peanuts flow through the spout in a substantially unobstructed manner.

Many alternative void fill materials are available for product packaging. For instance, shredded wood, cornstarch, shredded paper and popcorn are a few alternative void fill packaging materials. Many of these packaging materials are not lightweight and do not flow through a spout in a hopper assembly for placement around a product in its package. As such, these void fill materials must be placed around a package by hand. Such hand packing of heavyweight void fill material leads to injuries such as Carpal Tunnel Syndrome. Other packing materials, such as cornstarch and popcorn, attract insects. Cornstarch, shredded paper and popcorn also tend to deposit natural oils, ink or other residue upon the products which they surround. Most of these void fill materials also possess the disadvantage of degradation in cushioning ability at a higher rate than polystyrene "peanuts" thereby making it impractical as a void fill material. Further, the high cost of most of these packing materials make their use prohibitive.

A known method of recycling corrugated cardboard provides an inexpensive and environmentally safe alternative to void fill packing materials. The best known packaging material implemented in this fashion is "quadropack" which is recycled shredded corrugated cardboard fan-folded into strips. This product, however, does not dispense easily through a hopper assembly because of negative "flow" characteristics through a lower spout.

Rotary die cutters, however, could produce an effective void fill material made from recycled cardboard or hardboard sheet papers products with better flow characteristics.

Void fill material made from recycled paper products also avoid the disadvantages inherent in previously used void fill materials. This void fill material is environmentally safe and avoids the addition of unrecycled material to waste dumps. Further, this void fill material is lightweight, does not attract insects and does not leave any residue on the packaged product.

The use of rotary die cutters is well known for preparing cardboard and paper products for commercial applications. Most rotary die cutters include a dual cylinder design wherein one cylinder is the cutter cylinder and the other cylinder is the anvil cylinder. During operation, an unworked piece of cardboard is placed between the cutter cylinder and the anvil cylinder such that the anvil cylinder supports the cardboard while the blades on the outside of the cutter cylinder work upon the cardboard. The use of the rotary die is herein explained using cardboard as the work piece, but it is understood that any type of hard or firm sheet material may be worked upon by this type of rotary die cutter for use as void fill material.

Rotary die cutters work upon the cardboard to cut, score or crease the cardboard in the manner desired. The cutter cylinder usually possess different types of blades to perform each operation. Cutting blades are long, sharp blades for cutting the cardboard. Scoring blades are long, serrated blades for scoring the cardboard so the cardboard may be easily folded upon the scored line. And, creasing blades are shorter, blunt blades used for making shallow creases or impressions in the cardboard or paper products thereby bending or folding the cardboard at the crease. Together, these blades shape and configure the cardboard workpiece to suit the particular commercial application desired.

The cardboard usually originates from a supply stack and is conveyed to the rotary die cutter. Once conveyed to the rotary die cutter, the cardboard is fed between the cutter and anvil cylinders. One or both cylinders are rotated in order to continuously feed the cardboard product between the cylinders. The rotation of the cylinders moves the cardboard therethrough and onward to another conveying means. Ultimately, the final workpiece is transferred to an output destination. The rotation of the cylinders, as well as the conveying means and feeding process, are accomplished by means well-known in the art.

After the cardboard product is worked upon by the rotary die cutter, workpieces and waste material are usually created. Portions of the cardboard not to be used in the final commercial product are considered waste material. Sometimes the entire piece of cardboard fed between the cylinders is used as the final commercial product without the production of any waste material. Both the waste material and the workpiece, however, must be ejected from the die cutting cylinder in order to provide a clean cutting surface when the cutter cylinder rotates around again to work upon the next surface of a cardboard piece conveyed to the rotary cutter device.

Ejector or ejection systems are often used to assure the ejection of the workpieces and any waste material so as to avoid any obstruction of the cutting surface of the rotary die cutter. Known ejection systems include mechanical and magnetic types of ejection systems. Mechanical ejectors include foam rubber and other spring-type ejectors placed within the cutting areas. These mechanical types of ejectors expand after the actual cutting operation is completed to eject the cut workpiece. Magnetic ejectors include magnetic material which is attracted and moved at a certain position in the cutting cycle to force the workpiece or waste material away from the cutter cylinder.

These mechanical and magnetic ejection systems possess numerous disadvantages when implemented in systems producing a large number of small workpieces. For instance, it is impractical in many instances to place mechanical or magnetic ejectors in each of the separate cutting elements when the number of cut workpieces is very large. Additionally, the foam rubber spring-type ejectors cannot expand sufficiently from the cutter cylinder when the cut workpiece is small.

Pressurized gas has also been used to force workpieces away from the cutter blades or activate plungers on the exterior of the cutter cylinder to force the workpiece away from the cylinder by the force of the plunger. Many cutter cylinders possess coverings on the outer surface of the cutter cylinder, however, which obstruct the pressurized airflow used to eject cut workpieces in a gas pressurized ejection system. When a large number of small workpieces are cut, the pressurized airflow must minimize the number of obstructions so that sufficient airflow forces each cut workpiece away from the cutter cylinder. Thus, simple pressurized air systems possess substantial disadvantages when implemented on a cutter cylinder possessing obstacles to the airflow on the surface of the cutter cylinder. Further, plungers are expensive and impractical when the number of cut workpieces is very large.

Most cutter cylinders are fabricated by placing a plywood cover over a base mount cylinder. A single long cutting blade is bent into the configuration desired to cut the sheet material. This bent blade is hammered into the plywood outer cover thereby allowing the cutting blades to extend in a secured fashion radially on the cutting cylinder. The cutting cylinder is then ready to work upon the cardboard.

The placement of the cutting blades in the plywood cover of the base mount cylinder requires a tremendous amount of skill and experience to accomplish correctly. Thus, the placement and replacement of cutter blades is a very difficult process for an unexperienced worker. Another substantial disadvantage with this technique is the need to replace an entire blade portion of this cutter cylinder in the event the blade is damaged or defective. Replacement of the entire blade is often an expensive and time-consuming proposition, and is necessary even if only a small portion of the blade is damaged or defective. Further, gas pressurized ejection systems will not work effectively in this conventional cutter cylinder due to the obstructions imposed by the plywood covering.

SUMMARY OF THE INVENTION

This invention provides for the easy conversion of sheet material into a void fill material having interlocking members. The cardboard material is cut by the cutter and anvil cylinder arrangement wherein the interlocking members of the void fill material are formed by the cutting blades on the cutter cylinder.

The sheet material, such as corrugated cardboard, is environmentally safe as opposed to void fill material containing CFCs. By recycling cardboard or sheet material through the present invention, the cardboard or sheet material will not be placed in landfills thereby providing another beneficial environmental impact. Corrugated void fill is easy to create, handle and dispense from a hopper assembly, and is inexpensive compared to many void fill materials. Additionally, this material does not possess the detrimental side-effects of releasing oils, ink or residue onto the packaged material or attracting insects like cornstarch or popcorn void fill materials.

In carrying out the invention, a cutter cylinder possesses a multitude of cutting elements. Each cutting element comprises longitudinal cutting blades which cut the sides of the workpiece and radial cutting blades which cut an intricate shape between the longitudinal cutting elements. Each cutting element is replicated over the entire surface of the cutting cylinder.

A base mount cylinder supports the cutting blades and clamping elements on the surface of the cutter cylinder. The base mount cylinder is a long enclosed cylinder possessing an internal cavity. The surface of the base mount cylinder possesses a multitude of apertures. Each aperture allows air flow passage from the cylinder's internal cavity to the exterior of the cylinder.

The blades are secured to the cutter cylinder by clamping elements. Each clamping element includes a clamp plate, a rubber clamp and a securing bolt. The blades are placed between contiguous or abutting clamping elements. The clamping elements are then secured to the base mount cylinder. As the clamping elements are secured to the base mount cylinder, one or both contiguous clamping elements exert lateral pressure against the blades residing between contiguous clamping elements. The pressure placed on the blades by the clamping elements secures the blades to the base mount cylinder.

Each clamping element is secured to the exterior of the base mount cylinder with a securing bolt. The securing bolt is threaded through apertures in the clamp plate and rubber clamp and into a single aperture of the base mount cylinder. As the bolt is tightened, the clamp plate compresses the rubber clamp which is situated between the clamp plate and the base mount cylinder. This compression causes the rubber clamp to expand laterally and apply pressure to the blade placed between contiguous clamping elements.

The pressure placed upon the cutting elements situated between contiguous rubber clamps secures the blades in a radial manner to the cutter cylinder. When a blade is damaged, the clamping elements surrounding the damaged blade are loosened by unthreading the securing bolt. After untightening the securing bolt, the lateral expansion of the rubber clamp is decreased and the damaged blade may be removed from the cutting cylinder. A replacement blade may then be inserted for the damaged blade. After replacement of the blade, the securing bolt of the contiguous clamping elements is re-tightened to again place lateral pressure on the blade thereby securing it to the exterior of the base mount cylinder.

The base mount cylinder possesses an internal cavity which is pressurized. The apertures on the base mount cylinder allow airflow from the internal cavity to the exterior of the base mount cylinder. The securing bolt which tightens the clamp plate and rubber clamp to the base mount cylinder is threaded into a single aperture in the base mount cylinder. The securing bolt occupying the aperture on the base mount cylinder is hollow thereby allowing pressurized air to flow from the internal cavity in the base mount cylinder through the hollow bolt in the aperture. This arrangement allows airflow to force cut workpieces and waste material away from the cutting cylinder with a minimum of obstructions. Without a hollow securing bolt, the pressurized air emitted from the internal cavity of the base mount cylinder would be obstructed and could not effectively eject the cut workpiece away from the cutter cylinder.

This invention allows for easy replacement and repair of cutting blades on a rotary die cutter cylinder. In order to accomplish this task, the invention includes a securing and releasing mechanism of the blades on a base mount cylinder so that damaged or bent blades may be conveniently removed and replaced. The invention does not require an extremely high level of technical skill to operate the secure and release mechanisms of the blades or to replace blades. This invention also allows for inexpensive replacement of the cutting blades because each blade is only a segment of the entire cutting mechanism thereby allowing any damaged blade segment to be replaced individually by an identical blade segment. This method of replacement eliminates the need for replacement of an entire cutting blade or blade portion.

The invention also provides for ejection of small-sized cut figures from the cutter cylinder with the use of pressurized gas. The pressurized gas emitted from the internal cavity in a base mount cylinder to the exterior of the cylinder forces the ejection of each of the cut workpieces. This invention permits airflow against each of the cut workpieces even though the surface of the cutter cylinder is covered by clamping elements and blades. Thus, this invention accommodates a pressurized air ejection system with a cutter cylinder having outer surface which would normally obstruct air flow.

DETAILED DESCRIPTION OF THE INVENTION

Figure 1A:
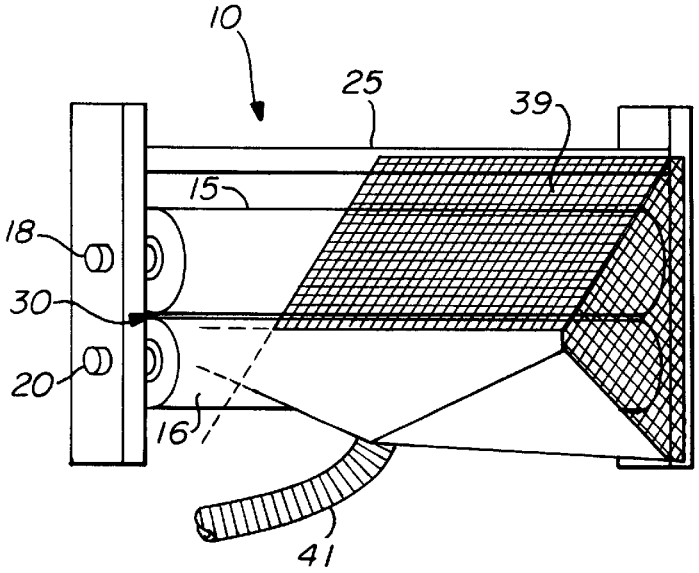
FIG. 1A is a detailed view of the equipment used to create and collect the cut void fill material; including the cutter and anvil cylinders.
Figure 2A:
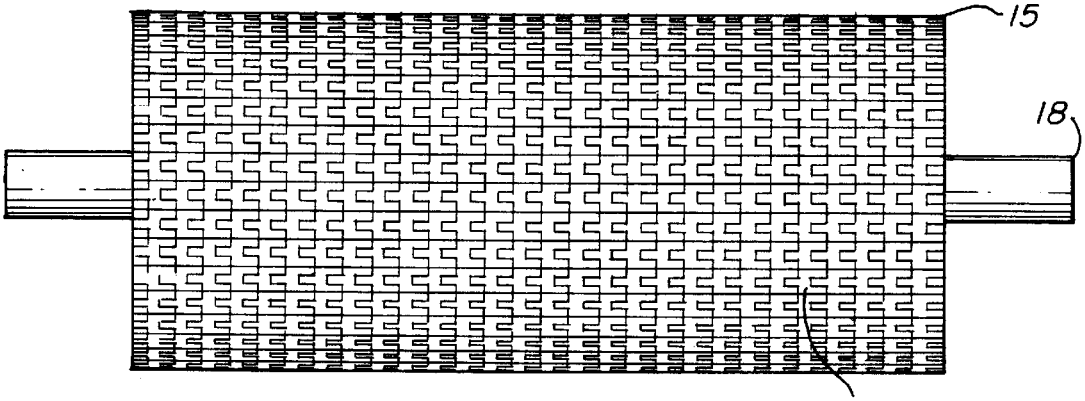
FIG. 2A is a topside view of the cutter cylinder with the multitude of cutting elements thereon.
Figure 2B:
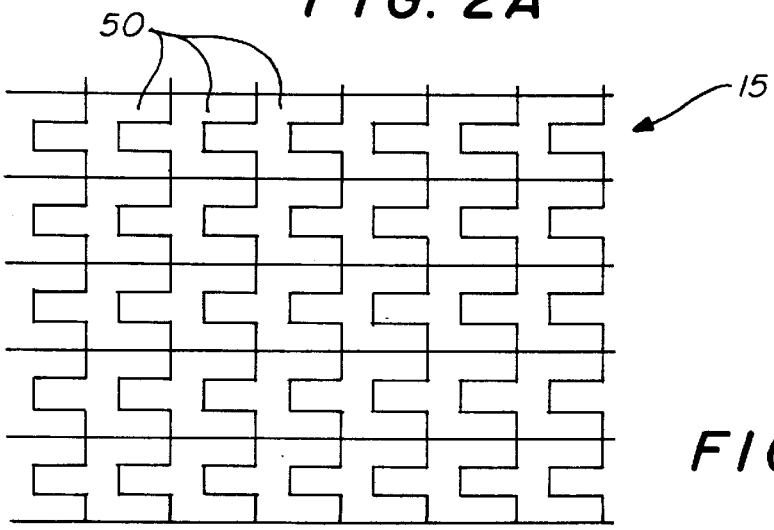
FIGS. 2B is a topside view of the cutting elements on the cutter cylinder.

Referring to FIG. 1A, rotary die cutting apparatus 10 is shown with a cutter cylinder 15 and anvil cylinder 16. Both cylinders 15 and 16 are attached to structural framework 25. Cutter cylinder 15 rotates on axle 18 while anvil cylinder 16 rotates on axle 20. The cutter and anvil cylinders 15 and 16 are rotated by conventional power means well known in the art. The actual cutting surface of the cutter cylinder 15 is shown in FIGS. 2A and 2B. The surface of the anvil cylinder 16 is usually smooth and compressible to allow slight penetration by the cutting blades while still maintaining a supporting position for the workpiece.

Figure 1B:
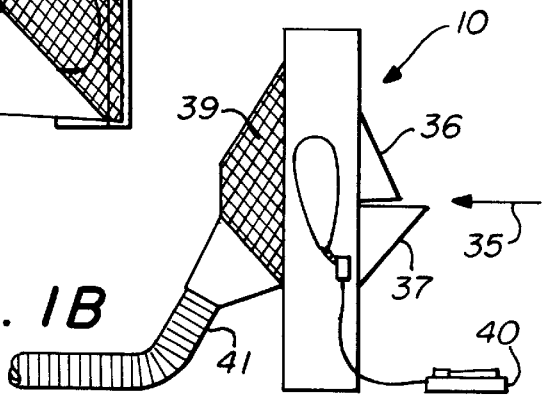
FIG. 1B is a side view of the equipment used to create and collect the void fill material.

The cardboard and other sheet product is inserted into gap 30 between cutter cylinder 15 and anvil cylinder 16. The cardboard is inserted into gap 30 on the opposite side of structural framework 25 shown in FIG. 1A shown as 35 in FIG. 1B. Safety guards, or protectors, 36 and 37 surround the gap 30 on the apparatus framework 25 in the insertion direction 35 so that no injuries will be sustained by workers inserting cardboard into gap 30. Upon insertion into gap 30, the cutting, creasing and scoring blades on exterior surface of cutter cylinder 15 work upon the cardboard piece while cylinder 16 supports the workpiece during the operation.

After the cutting operation is complete, the cut material is ejected form the cutter cylinder 15 and caught by the screen 39. The cut material is collected by screen 39 and flows through duct 41 to a hopper assembly (not shown). The hopper assembly retains the cut work pieces for subsequent dispensing through spout in the lower portion of the hopper into the packaging environment surrounding the package product.

Referring to FIG. 2A, the cutting blade configuration on the exterior of cutter cylinder 15 is shown. An individual workpiece is cut from each cutting element 50. FIG. 2B shows a closer view of cutting element 50 on cutter cylinder 15. As can be seen, each individual cutting element 50 is identical to the other cutting elements 50. The cutting element 50 has a singular upper portion and two lower leg portions. The workpieces cut by the cutter cylinder from the cardboard material will possess this same shape including an upper portion and two lower portions.

Figure 2C:
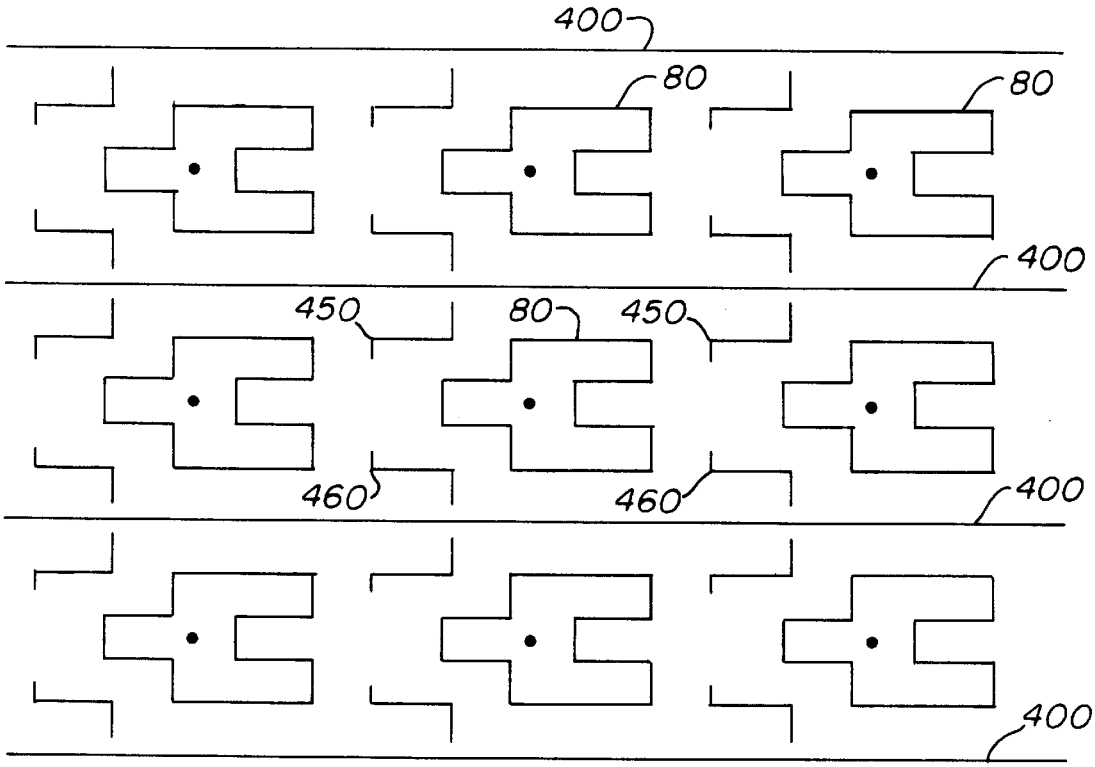
FIG. 2C is a topside view of the individual cutting blades and clamping elements placed upon the base mount cylinder.

Many of the individual components of the cutting and clamping elements are shown in FIG. 2C. The cutter cylinder possesses longitudinal cutting elements 400 which work in conjunction with radial cutting elements 450 and 460. The longitudinal cutting elements are long, straight blades which extend the entire length of the cutting cylinder. The radial cutting elements 450 and 460 are short, bent cutting blades which intricately cut the cardboard workpiece. The longitudinal blades 400 and the radial blades 450 and 460 are secured in a radial fashion to the cutter cylinder between clamping elements 80.

Figure 3:
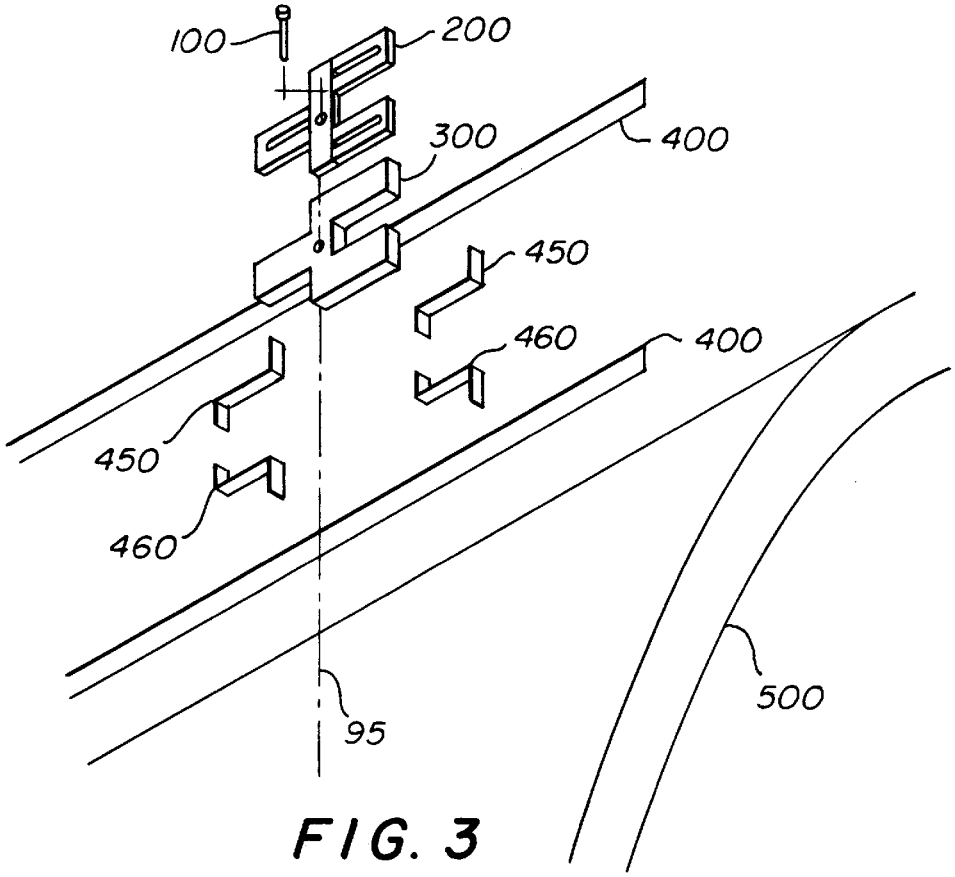
FIG. 3 is a perspective view of each element placed upon the base mount cylinder.

FIG. 3 is the perspective view of one cutting element assembly. This single cutting assembly must be used in conjunction with other surrounding clamping elements in order to secure the cutting blades to base mount cylinder 500.

The clamping element 80 in FIG. 2C comprises the securing bolt 100, the clamp plate 200 and the rubber clamp 300. As shown in FIG. 3, bolt 100 is placed through clamp plate 200 and rubber clamp 300, respectively, and into aperture 95 so as to attach the clamping element 80 to the base mount cylinder 500. The clamp plate 200 is placed over the rubber clamp 300 when the bolt 100 is placed therethrough. The bolt 100 is threaded into aperture 95 of the base mount cylinder 500. After bolt 100 is tightened into the aperture 95, the clamp plate 200 is compressed against the top of the rubber clamp 300 thereby forcing the rubber clamp 300 to expand in the lateral direction. The bolt 100 is hollow to allow air flow passage from the internal cavity of the base mount cylinder 500 to the exterior of the cylinder.

The longitudinal blades 400 and radial blades 450 and 460 are placed adjacent to the clamp plate 200 and rubber clamp 300 before the bolt is fully tightened into aperture 95 on the base mount cylinder 500. Adjacent clamp assemblies are then placed around the radial blades 450 and 460 and the longitudinal blades 400 as shown in FIG. 2C. After the radial and longitudinal blades are surrounded by adjacent contiguous clamp assemblies, the bolt 100 is tightened into the base mount cylinder 500 of each clamping element 80 thereby forcing the clamp plate 200 downward and expanding the rubber clamp 300 laterally. Pressure exerted downward by the clamp plate 200 after the bolt 100 is tightened results in the lateral expansion of the rubber clamp. This lateral expansion applies pressure to the blades placed between contiguous surfaces of abutting clamping elements thereby securing the cutting blades to the base mount cylinder 500.

Figure 4C:
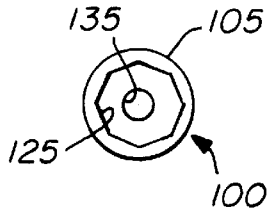
FIG. 4C is a top view of the securing bolt.
Figure 4A:
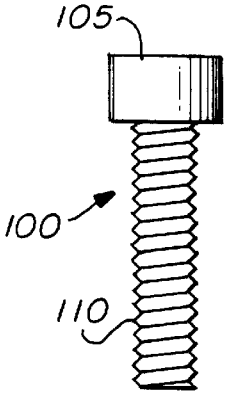
FIG. 4A is a side view of the securing bolt.
Figure 4B:
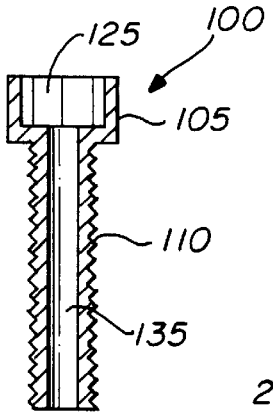
FIG. 4B is a cross-sectional view of the securing bolt.
Figure 5C:
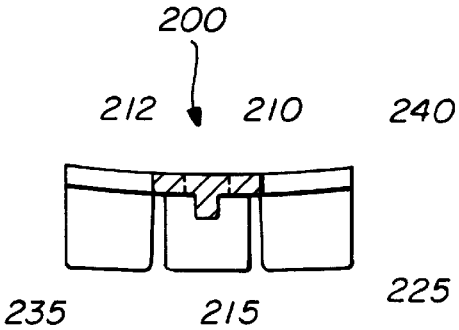
FIGS. 5B, 5C and 5D are side views of the clamp plate.
Figure 5B:
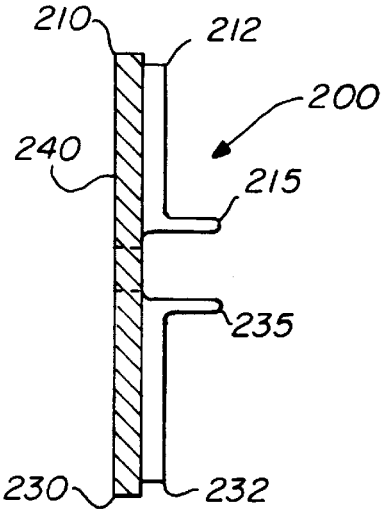
Figure 5A:
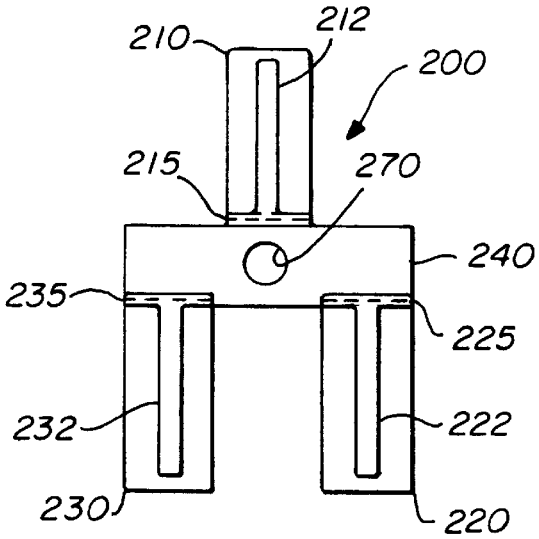
FIG. 5A is a top view of the clamp plate.

FIG. 4A is the side view of securing bolt 100 including a head portion 105 and threaded portion 110. FIG. 4B is a cross-sectional view of securing bolt 100 including the hollow inner cavity 125 and 135. Cavity 125 is a larger cavity in comparison to the hollow cavity 135 stretching the entire length of the threaded portion 110 of the bolt 100. Cavity 125 of the securing bolt 100 also possesses an octagonal squared configuration so the bolt 100 may be tightened by radial movement actuated by a wrench. That is, the bolt 100 is secured to base mount cylinder 500 by placing an octagonal wrench head within the hollow portion 125 and bolt 100 radially. The octagonal configuration in cavity 125 is shown in FIG. 4C. The hollow cavity 135 in the securing bolt 100 is preferably at least equal in diameter to the radius of the threaded portion 110 of the bolt 100. FIG. 5A is a top view of the clamp plate 200. The clamp plate 200 may be constructed of any hardened partially mailable material, but is preferably made of cast aluminum.

Clamp plate 200 comprises a body portion 240 which extends into an upper portion 210 and two lower portions 220 and 230. The clamp plate 200 also possesses an aperture 270 for the placement of the threaded portion 110 of securing bolt 100 therethrough. The head portion 105 of bolt 100 is located over this aperture 270 and is necessarily larger than the aperture 270. Threading the securing bolt 100 into aperture 95 will apply pressure to the clamp plate 200 through the force exerted by the head portion 105 on the clamp plate 200.

Clamp plate 200 possesses supporting structures 212 on the upper portion 210, 222 on the lower right portion 220 and 232 on the lower left portion 230. These supporting structures assist in the application of uniform pressure along the entire body portion 240 of the clamping plate 200. Without such supporting structures, one portion of the clamp plate 200 may apply less pressure upon the rubber clamp 300 than on another portion of the clamp plate 200. The width of the supporting structures 212, 222 and 232 are approximately ⅓ the width of the upper and lower portions 210, 220 or 230. Additionally, the supporting structures 212, 222 and 232 extend almost to the end of the upper and lower portions 210, 220 and 230 of body portion 240 so as to provide the maximum support possible to the upper and lower portions of the rubber clamp 300.

Three creasing blades 215, 225 and 235 are also positioned on the upper portion 210 and lower portions 220 and 230, respectively. As can be seen in FIG. 5B, the creasing ridges 215 and 235 extend substantially upward from the supporting structures 212 and 232 and the body portion 240. Preferably these creasing blades 215, 225 and 235 are three times the height of the supporting structures 212, 222 or 232. These short creasing blades 215, 225 and 235 place pressure upon the cardboard thereby creasing the workpiece at predetermined points. Creasing should be accomplished without actual cutting, so these creasing blades 215, 225 and 235 are shorter, blunt blades.

Figure 5D:
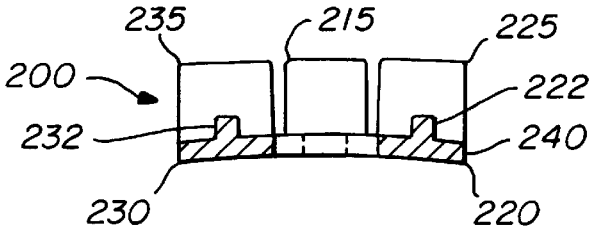

FIG. 5B is a side view of the clamping plate including the body portion 240 extending under the supporting structures 212 and 232. FIGS. 5C and 5D are also side views of the clamping plate 200. As can be seen from FIGS. 5C and 5D, the body portion 240 is preferably the same thickness as the supporting structures 222 or 232. FIGS. 5C and 5D demonstrate the curvature of the clamping plate for placement on the exterior of the cutting cylinder. The use of a three segmented creasing blade configuration is well adapted for compensating of the curvature of the cutter cylinder. As can be seen in FIGS. 5A through 5D, the hole structure 270 passes through the body portion 240 and preferably possesses a radius less than the width of the supporting structure 212, 222 and 232.

Figure 6C:
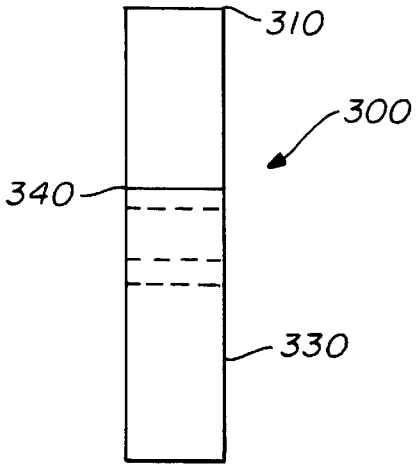
FIGS. 6B and 6C are side views of the rubber clamp.
Figure 6A:
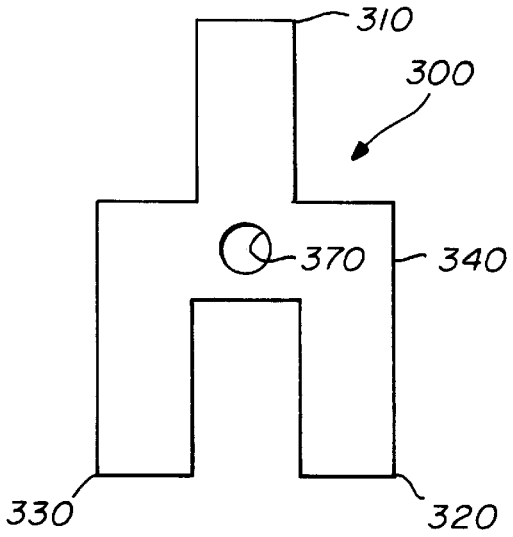
FIG. 6A is a top view of the rubber clamp.

As shown in FIG. 6A, the rubber clamp 300, in its uncompressed form, is the same length as the clamp plate 200. Additionally, the rubber clamp 300 has slightly less width in its uncompressed form than the clamp plate 200. When compressed by the downward force of the clamping plate 200, the rubber clamp 300 expands laterally increasing the width of the rubber clamp beyond the width of the clamp plate 200. Other than the above differences in dimensions, a majority of the other dimensions of rubber clamp 300 are substantially identical to clamp plate 200.

The rubber clamp 300 is preferably manufactured of molded neoprene, but it can be manufactured using any substance which is easily compressible and expands laterally upon a downward compression force. This lateral expansion is important in the invention because the lateral expansion of the rubber clamp secures the blades on the base mount cylinder 500. It is possible, however, to secure cutting blades to the base mount cylinder 500 with little or no lateral expansion if the clamping elements 80 are placed in close proximity to one another on the surface of the base mount cylinder 500.

Figure 6B:
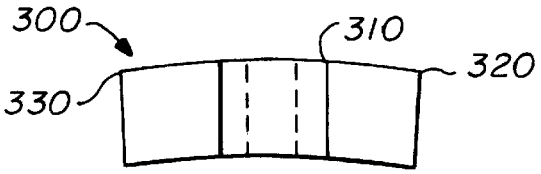

FIG. 6A is the top view of the rubber clamp 300, while FIGS. 6B and 6C are side views of the rubber clamp 300. The rubber clamp 300, like the clamp plate 200, possesses an upper portion 310 and lower portions 320 and 330. Also like the clamp plate 200, the rubber clamp 300 possesses a hole segment 370 for placement of the securing bolt 100 therethrough. The hole segment 370 is slightly larger than the hole structure 270 in order to compensate for the lateral expansion inside the hole segment 370 during compression of the rubber clamp 300 by the clamp plate 200. FIG. 6B demonstrates the curvature of the rubber clamp 300 as it is placed on the surface of the base mount cylinder 500.

Figure 7B:
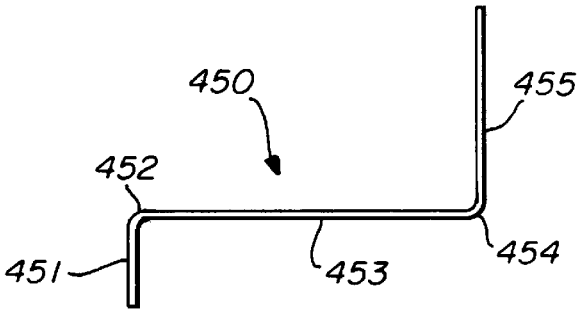
FIG. 7B is a top view of the right radial cutting blade.
Figure 7A:
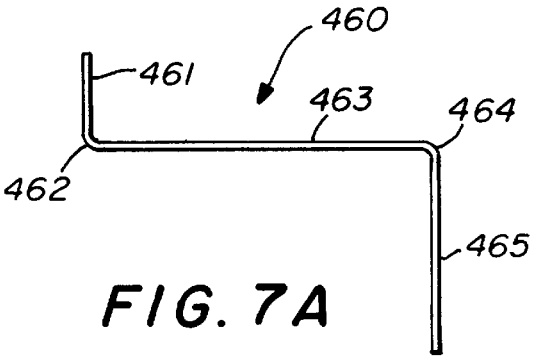
FIG. 7A is a top view of the left radial cutting blade.

FIG. 7A is the top view of the left radial cutting blade 460 used in conjunction with the reciprocal right radial cutting blade 450 in FIG. 7B. Together these blades surround the upper portion of the clamping element 80. The left radial cutting blade 460 possesses a short arm portion 461, a middle portion 463 and a long arm portion 465. The left radial cutting blade 460 possesses two right-angled bends at 462 and 464 between the short and middle arms 461, 463 and middle and long arms 463, 465, respectively.

The right radial cutting blade 450 in FIG. 7B, like the left radial cutting blade 460, includes a short cutting arm 451, a middle portion 453 and a long cutting arm 455. The right radial cutting blade also possesses two right angled bends 452 and 454 between the short and middle arms 451, 453 and the middle and long arms 453, 455, respectively.

The radial cutting blades 450, 460 have a uniform height from the bottom portion of the blade which touches the base mount cylinder 500 to the exterior cutting edge which cuts and contacts the cardboard material. The height of these cutting blades is shown in a side view of the long and short arm portions of these blades in FIGS. 8A and 8B. The uniform height of the short portion of blade 461 is shown on side of FIG. 8A. Likewise, the uniform height of the long portion of blade 455 is shown on sides of FIG. 8B.

Figure 8B:
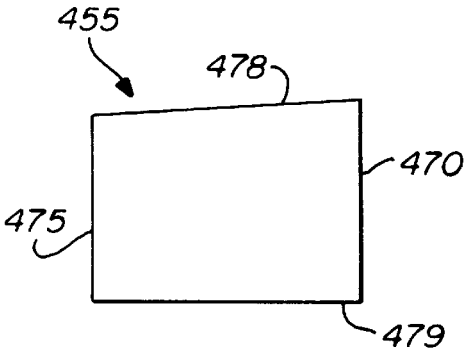
FIG. 8B is a side view of the long arm of the right radial cutting blade.
Figure 8A:
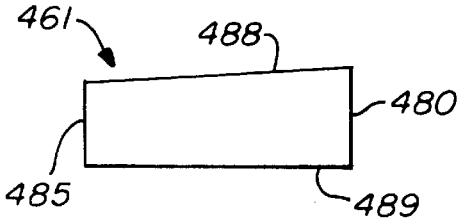
FIG. 8A is a side view of the short arm of the left radial cutting blade.

As shown in FIG. 8B, the width of the long arm blade 455 is narrower on edge 475 which touches the base mount cylinder 500 than at 470 which is the cutting edge portion of the long portion 455 of the radial blade 450. The cutting blade 450 must have an angled side 478 to compensate for the radial circumference of the cutting cylinder. The long arm portion 455 of the radial blade 450 must be narrower at the base mount cylinder 500 than on the cutting edge to compensate for the circular surface of the base mount cylinder 500 and the cutting edges of the cutting apparatus. That is, in order to compensate for the reduced circumference at the base mount cylinder 500 as compared to the cutting edge of the die cutter cylinder, the edge 475 of the long arm 455 must be narrower than the cutting edge 470 of the long arm 455. Likewise, the long arm 465 of the left radial arm 460 must also compensate for increased circumference around the perimeter of the cutting edge of the cutting cylinder 15.

Like the long cutting arms, the short arm portions of the radial cutting blades 451, 461 are also narrower at the base edges 485 which contact the base mount cylinder 500 than at their respective cutting edges 480. The need for a narrower portion of the cutting blade which contacts the base mount cylinder 500 is demonstrated in FIG. 8A with the narrower portion 485 as compared to the cutting edge 480. The side 488 is angled to compensate for the radial circumference of the cutting cylinder. This requirement for angled blades applies to the short arm of both radial cutting blades 461 and 451.

Figure 9:
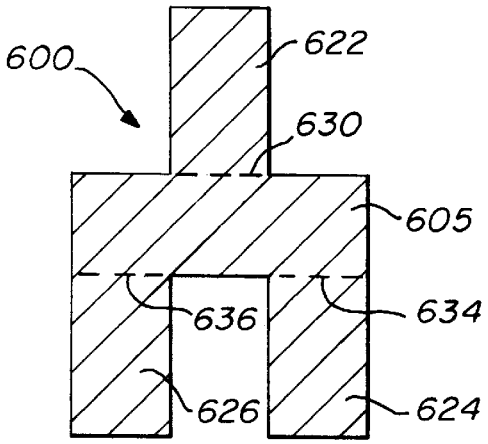
FIG. 9 is a flat view of the block "Y" embodiment void fill material cut by the present invention.

A void fill material 600 embodying the material cut by the present invention is disclosed in FIG. 9. Void fill material 600 is comprised of a primary section 605 and, in a preferred embodiment, three appendages or "fingers" 622, 624, 626. Typically, a first finger 622 is attached to one side of primary section 605, while a second and third finger 624, 626 are located on the opposite side of primary section 605. The intersection of each finger 622, 624, 626 with primary section 605 can be scored to allow for bending of each finger away from the plane defined by primary section 605. scoring or creasing liens are shown as 630, 634 and 636 for each finger 622, 624 and 626, respectively.

In a preferred embodiment, the first finger 622 can be 1 inch in length and ½ inch in width. The second and third fingers 624, 626 can be 1 inch in length by 9/16 inch in width. The primary section 605 can be 1⅝ inch in length and ½ inch in width. The second and third fingers 624, 626 are separated by a distance of ½ inch. This, the first finger 622 of one piece of packing material 600 can engage the area between the second and third fingers 624, 626 of an adjacent piece of packing material. Of course, the dimensions provided describe only one embodiment of the invention, and can be altered to suit an individual's needs.

Figure 10:
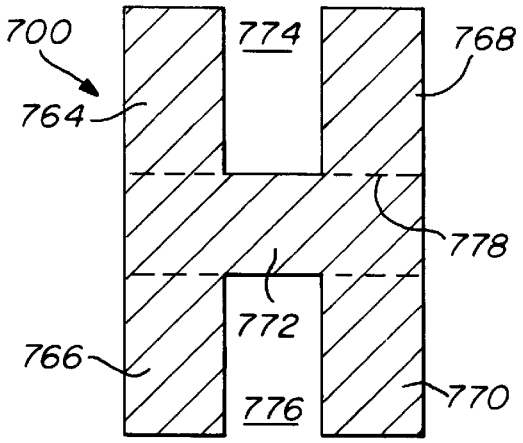
FIG. 10 is a flat view of the "H" embodiment void fill material but by the present invention.

FIG. 10 is a flat sectional view of an "H" embodiment 700 of the void fill material cut by the present invention. The "H" void fill 700 is comprised of four limbs 764, 766, 768, 770 attached to a primary section 772. Scoring 778 can be applied to the "H" void fill to increase its utility. In use, the scoring will allow the limbs to bend from the primary section 772. Scoring 778 is shown at the intersection of each limb 764, 766, 768, 770 and the primary section 772. However, the scoring can be applied at any location on the "H" void fill. Limbs 764 and 768 are separated by space 774 while limbs 766 and 770 are separated by space 776. Each space 774, 776 is typically the same width as each limb. Each limb is between ⅛ and 15/16 inches in width and ½ and 2 inches in length. The overall dimension of the "H" embodiment is between ½ and 3 inches in width and 1 and 3 inches in length. Preferably, the "H" embodiment is 1¼ inches in width and two inches in length. The thickness will vary according to the corrugated material used, but is typically between 1/16 and ⅜ inches. The exact dimensions of the void fill material, including the angles of cut and the amount of creasing and bending, may change depending on the particular application.

Figure 11:
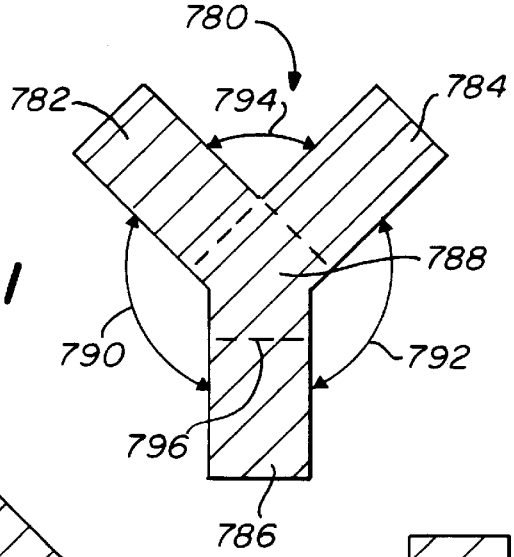
FIG. 11 is a flat view of the "angled Y" embodiment void fill material cut by the present invention.

FIG. 11 is a flat sectional view of an "angled Y" embodiment of the present void fill material. The "angled Y" void fill 780 is comprised of three limbs, 782, 784, 786 attached to a primary section 788. Scoring 796 can be applied to the "angled Y" void fill to increase its utility. Scoring 796 is shown at the intersection of each limb 782, 784, 786 in the primary section 788. However, the scoring can be applied at any location on the "angled Y" void fill. Limbs 786 and 782 are separated by a first angle 790. Limbs 782 and 784 are separated by a second angle 794. Limbs 784 and 786 are separated by a third angle 792. Each angle 790, 792, 794 is typically 120°. However, each angle may vary with no single angle being greater than 180°.

Each limb 782, 784, 786 is between ⅛ and 15/16 inches in width, and between ½ and 2 inches in length. The overall dimensions of the "angled Y" embodiment 780 is between ½ and 3 inches in width, and between 1 and 3 inches in length. Preferably, the "angled Y" embodiment is 1¼" in width and 2" in length. The thickness will vary according to the corrugated material used, but is typically between 1/16 and ⅜ inches. The exact dimensions of the void fill material, including the angles of cut and the amount of creasing and bending, may change depending on the particular application.

Figure 12:
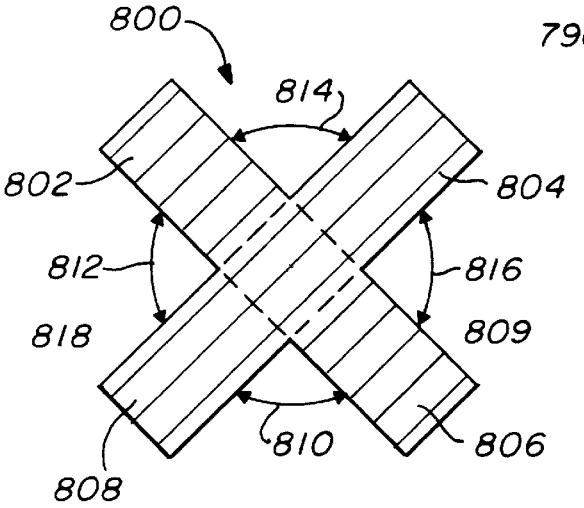
FIG. 12 is a flat view of the "X" embodiment void fill material cut by the present invention; and, FIG. 13 is a flat view of the "cross" embodiment void fill material cut by the present invention.

FIG. 12 illustrates an "X" embodiment 800 of the present void fill material. The "X" void fill 800 is comprised of four limbs 802, 804, 806, 808 attached to a primary section 809. Scoring 818 can be applied to the "X" void fill to increase its utility. Scoring 818 is shown at the intersection of each limb 802, 804, 806, 808 and the primary section 809. However, the scoring can be applied at any location on the "X" void fill. Limbs 802 and 804 are separated by angle 814. Limbs 804, 806 are separated by an angle 816. Limbs 806 and 808 are separated by an angle 810. Limbs 808 and 802 are separated by an angle 812. Each angle 810, 812, 814, 816 is typically 90°. However, each angle may differ, with no single angle being greater than 1800. Each limb 802, 804, 806, 808 is between ⅛ and 15/16 inches in width, and between ½ and 3 inches in length. The overall dimension of the "X" embodiment 800 is between ½ and 3½ inches and width, and between 1 and 4 inches in length. Preferably the "X" embodiment is 1¼ "in width and 2" in length. The thickness will vary according to the corrugated material used, but is typically between 1/16 and ⅜ inches. The exact dimensions of the void fill material, including the angles of cut and the amount of creasing and bending, may change depending on the particular application.

Figure 13:
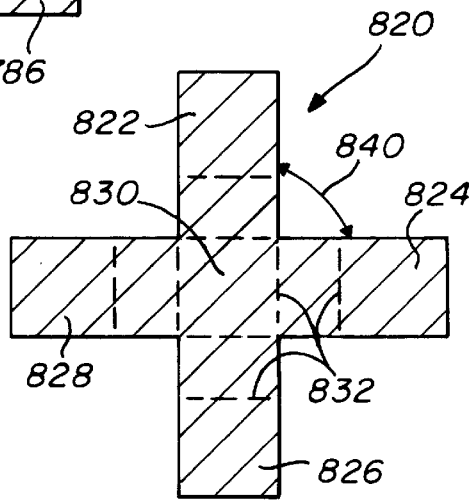

FIG. 13 illustrates a "cross" embodiment 820 of the present void fill material. The "cross" void fill 820 is comprised of four limbs 822, 824, 826, 828 attached to a primary section 830. Scoring 832 can be applied to the "cross" void fill to increase its utility. Scoring 832 is shown at an intermediate portion of each limb as well as at the intersection between each limb and the primary section. In other words, multiple scoring can be applied to any limb, or no scoring need be applied at all. Each limb is separated by an angle 830 as shown. Angle 840 is 90°. Each limb 822, 824, 826, 828 is between ⅛ and 15/16 inches in width, and between ½ and 3 inches in length. The overall dimension of the "cross" void fill 830 is between ½ and 3½ inches in width, and between 1 and 4 inches in length. Preferably, the "cross" void fill is 1¼" in width and 2" in length. The thickness will vary according to the corrugated material sued, but is typically between 1/16 and ⅜ inches. The exact dimensions of the void fill material, including the angles of cut and the amount of creasing and bending, may change depending on the particular application.

The cutting blade and clamp dimensions will correspond to the dimensions set out for each of the cut workpieces, but can be varied to accommodate the individual configuration of the workpiece. Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the scope of the claimed invention.

We claim:

1. A process for manufacturing void fill material comprising the steps of:

providing a rotary cutting surface;

providing an anvil surface opposing said rotary cutting surface;

inserting a sheet material between said cutting surface and said anvil surface; and cutting said sheet material into a plurality of substantially planar pieces of void fill material wherein said pieces of said void fill material possess at least one finger projection extending linearly from a primary plane and at least two finger projections extending from said primary plane and dimensioned to receive projections from adjacent pieces of void fill material in an interlocking manner in a gap formed between said two projections;

placing said pieces of void fill material randomly around a packaged item inside a container for the package item.

2. The process of claim 1 wherein said void fill material is configured as a block Y.

3. The process of claim 1 wherein said void fill material is configured as a block H.

4. The process of claim 1 wherein said void fill material is configured as an angled Y.

5. The process of claim 1 wherein said void fill material is configured as an X.

6. The process of claim 1 wherein said sheet material includes corrugated cardboard.

7. The process of claim 1 wherein said sheet material includes chipboard.

8. The process of claim 1 wherein said sheet material possesses intrinsic stiffness.

9. A process for manufacturing void fill material comprising the steps of:

providing a rotary cutting assembly;

providing a rotary anvil surface opposing said rotary cutting assembly;

inserting a sheet material between said rotary cutting surface and said rotary anvil surface;

cutting said sheet material into a plurality of substantially planar pieces of said void fill material wherein said pieces of said void fill material possess at least one finger projection extending linearly from a primary plane and at least two finger projections extending from said primary plane and dimensioned to receive projections in an interlocking manner from adjacent pieces of void fill material in a gap formed between said two projections; and ejecting said plurality of pieces of void fill material from said rotary cutting assembly.

10. The process of claim 9 wherein said step of ejecting said plurality of pieces of said void fill material is accomplished by the application of a pressurized gas against the cut piece of said void fill material.

11. The process of claim 9 further comprising the step of collecting said pieces of void fill material for subsequent random dispersal around a packaged item.

12. A process for manufacturing void fill material comprising the steps of:

providing a cutting surface;

providing an anvil surface opposing said cutting surface;

inserting a sheet material between said cutting surface and said anvil surface;

cutting said sheet material into a plurality of substantially planar pieces of void fill material wherein said pieces of said void fill material possess at least one finger projection extending linearly from a primary plane and at least two finger projections extending from said primary plane and dimensioned to receive projections in an interlocking manner from adjacent pieces of void fill material in a gap formed between said two projections;

ejecting said plurality of pieces of void fill material from said rotary cutting surface; and placing said pieces of void fill material randomly around a packaged item inside a package.

13. The process of claim 12 wherein the step of ejecting said void fill material is accomplished using pressurized gas.

14. The process of claim 12 wherein said cutting surface is a rotary cutting surface and the anvil surface is a rotary anvil surface.

15. The process of claim 12 wherein said sheet material includes a corrugated cardboard.

16. The process of claim 9 further comprising the step of placing said pieces of void fill material randomly around a packaged item inside a package.

17. The process of claim 11 wherein said step of ejecting pieces of void fill material is accomplished with the application of pressurized gas against the cut piece of void fill material.

18. The process of claim 1 further comprising the step of ejecting said pieces of void fill material from said rotary die cutting surface.

19. The process of claim 18 wherein said step of ejecting pieces of void fill material is accomplished with the application of pressurized air against the cut pieces of void fill material.

20. The process of claim 1 further comprising the step of collecting cut pieces of void fill material for subsequent dispersal around a packaged item in a package.

* * * * *